US009022269B1

(12) United States Patent
Woodcock

(10) Patent No.: US 9,022,269 B1
(45) Date of Patent: May 5, 2015

(54) MODULAR FISHING VEST SYSTEM

(71) Applicant: Philip Woodcock, Westminster, CO (US)

(72) Inventor: Philip Woodcock, Westminster, CO (US)

( * ) Notice: Subject to any disclaimer, the term of this patent is extended or adjusted under 35 U.S.C. 154(b) by 0 days.

(21) Appl. No.: 13/966,140

(22) Filed: Aug. 13, 2013

(51) Int. Cl.
*A45F 4/12* (2006.01)
*A45F 4/00* (2006.01)
*A41D 13/00* (2006.01)

(52) U.S. Cl.
CPC ..... *A45F 4/00* (2013.01); *Y10S 224/9018* (2013.01); *A45F 2004/006* (2013.01); *A41D 13/0007* (2013.01); *A45F 4/12* (2013.01)

(58) Field of Classification Search
CPC ..... A45F 2004/006; A45F 4/12; A45F 3/042; A45F 2003/003; A45F 4/00; A45F 2200/05; A41D 13/0007; A45C 7/0086
USPC ..... 224/576, 578–583, 620, 650, 901.8
See application file for complete search history.

(56) References Cited

U.S. PATENT DOCUMENTS

| | | | | |
|---|---|---|---|---|
| 3,277,599 | A | 10/1966 | Griffeth | |
| 4,041,549 | A | 8/1977 | Atkinson | |
| 4,106,121 | A | 8/1978 | Belson | |
| 4,369,526 | A | 1/1983 | Clutts | |
| 4,382,302 | A | 5/1983 | Watson | |
| 5,011,334 | A | 4/1991 | Vorhauer | |
| 5,014,359 | A | 5/1991 | Hanson | |
| 5,119,910 | A * | 6/1992 | Heggeland | 190/116 |
| 5,123,117 | A * | 6/1992 | Prendergast | 2/108 |
| 5,247,707 | A | 9/1993 | Parker | |
| 5,397,040 | A | 3/1995 | Lee | |
| 5,465,425 | A * | 11/1995 | Crispin | 2/102 |
| 5,505,354 | A | 4/1996 | Hutton | |
| 5,526,535 | A * | 6/1996 | Dobrzenski | 2/102 |
| 5,526,969 | A * | 6/1996 | Greenberger | 224/153 |
| 5,619,819 | A | 4/1997 | Hauschild | |
| 5,628,141 | A | 5/1997 | Crawford | |
| 5,639,005 | A * | 6/1997 | Chouinard | 224/580 |
| 5,644,792 | A | 7/1997 | Tishler | |
| 5,718,000 | A | 2/1998 | Ost et al. | |
| 5,724,707 | A | 3/1998 | Kirk | |
| 5,729,869 | A | 3/1998 | Anscher | |
| 5,852,828 | A | 12/1998 | Foster | |
| 5,909,802 | A * | 6/1999 | Puco et al. | 2/102 |
| 5,991,925 | A | 11/1999 | Wu | |
| 6,119,269 | A | 9/2000 | Imler | |
| 6,267,276 | B1 | 7/2001 | Cook | |
| 6,382,490 | B1 | 5/2002 | Divincenzo | |
| 6,421,834 | B2 * | 7/2002 | Kester | 2/94 |
| 6,568,575 | B1 | 5/2003 | Bartholomew | |
| RE38,497 | E | 4/2004 | Falk | |

(Continued)

*Primary Examiner* — Justin Larson
*Assistant Examiner* — Scott McNurlen
(74) *Attorney, Agent, or Firm* — Leyendecker & Lemire, LLC

(57) ABSTRACT

A modular fishing vest system combining the load capacity of a backpack with the advantages of a fishing vest is described. The modular fishing vest system typically includes a fishing vest with a first storage module removably coupled to a back side of the vest. The first storage module can resemble a backpack. The modular fishing vest system typically further includes shoulder straps installed inside the fishing vest in order to transfer load to a user's shoulders. The shoulder straps are typically removably coupled to an inside surface of the vest. The modular fishing vest system further includes second storage modules detachably installed on a front side of the vest. The second storage modules can include a shelf pocket that opens to provide a shelf approximately horizontally disposed, on which pocket contents or other items can be supported.

13 Claims, 11 Drawing Sheets

(56) References Cited

U.S. PATENT DOCUMENTS

| | | | | |
|---|---|---|---|---|
| 6,874,163 | B2 | 4/2005 | Marshall | |
| 6,899,257 | B2 | 5/2005 | Jones | |
| 6,910,224 | B2 | 6/2005 | Ikenaga | |
| 6,923,357 | B2 | 8/2005 | Smith | |
| 7,013,596 | B1 | 3/2006 | Moore | |
| 7,594,569 | B2 * | 9/2009 | Bass et al. | 190/108 |
| 7,712,645 | B2 | 5/2010 | Calkin | |
| 7,900,392 | B2 | 3/2011 | Musto | |
| 2003/0173390 | A1 | 9/2003 | Smith | |
| 2004/0065708 | A1 * | 4/2004 | Amram | 224/579 |
| 2005/0120464 | A1 | 6/2005 | Clark | |
| 2006/0143774 | A1 | 7/2006 | Walsh | |
| 2007/0152009 | A1 | 7/2007 | Fishman | |
| 2011/0004968 | A1 | 1/2011 | Morgan | |
| 2014/0263517 | A1 * | 9/2014 | Redli | 224/576 |

* cited by examiner

MODULAR FISHING VEST SYSTEM

FIELD OF THE INVENTION

The present invention relates generally to fishing vests and tackle. More specifically, the present invention relates to a system that combines a fishing vest, a backpack, and fishing tackle bag functions.

BACKGROUND

Fishing vests are a good way for a user to organize and carry fishing tackle, but vests may lack sufficient load capacity for carrying gear, thus necessitating additional carrying means such as a backpack. However, a backpack can be cumbersome or awkward to wear while fishing, and can be especially cumbersome when worn over a fishing vest.

In some instances, a user can carry a fishing vest inside a backpack while approaching a location, and subsequently remove the vest from the backpack and don the vest while fishing. However, the fishing vest occupies valuable space inside the backpack in this scenario, and a somewhat larger backpack may be required to accommodate the fishing vest and its contents. Moreover, discomfort and poor performance of the backpack while fishing can induce a user to set the backpack aside while fishing, making the user susceptible to inadvertently abandoning the backpack or otherwise losing the backpack while absorbed in fishing.

Accordingly, a device or system that exploits the organization features and convenience of a fishing vest, but also includes the carrying capacity of a backpack, is needed.

DETAILED DESCRIPTION

Figure 1:
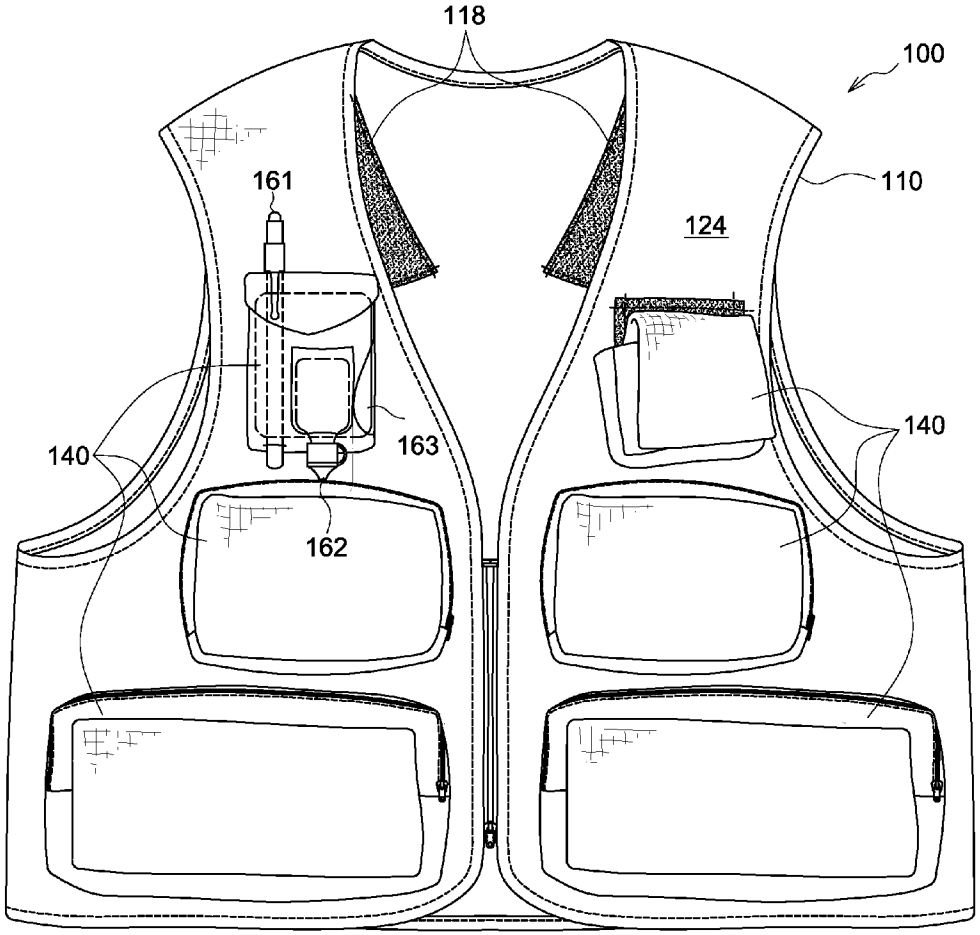
FIG. 1 is a front elevation view of a modular fishing vest system according to an embodiment of the present invention.
Figure 2A:
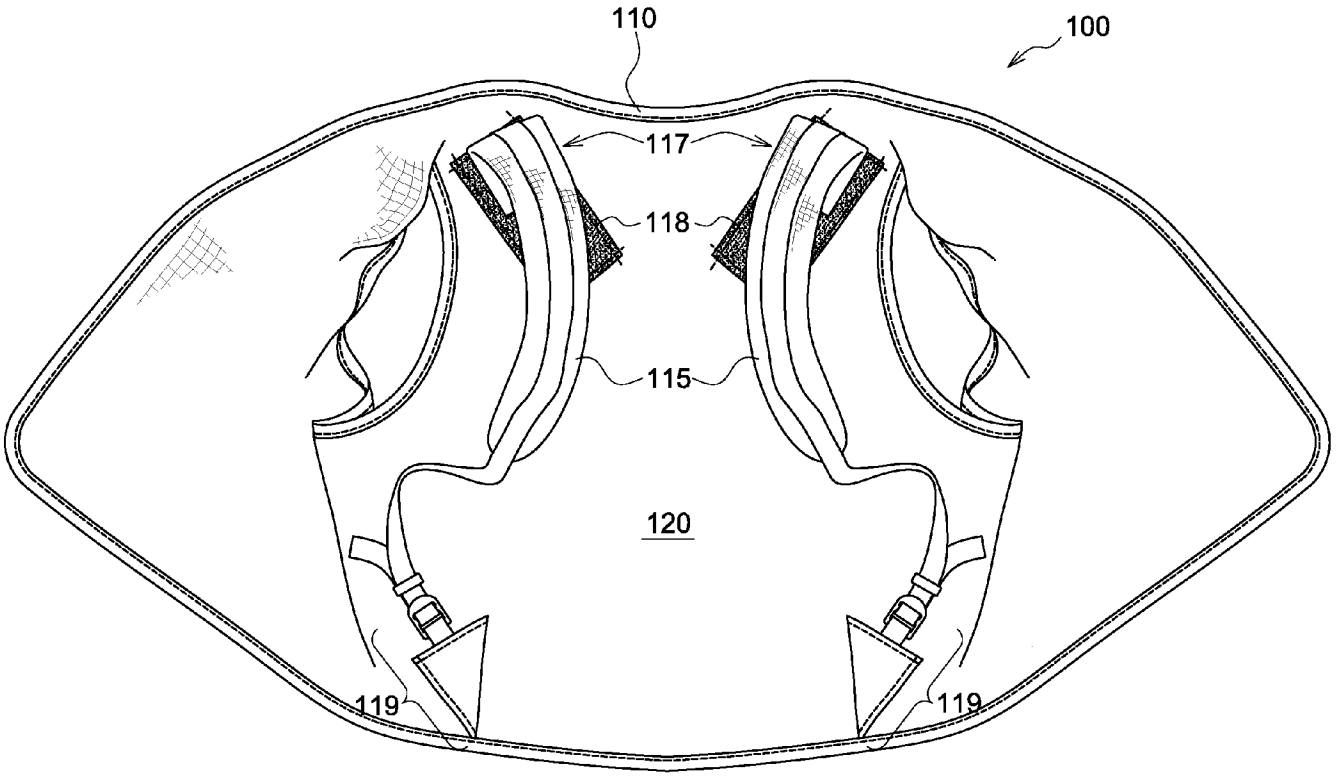
FIG. 2A is a front elevation view of a modular fishing vest system with the vest open to expose the vest interior, according to an embodiment of the present invention.
Figure 2B:
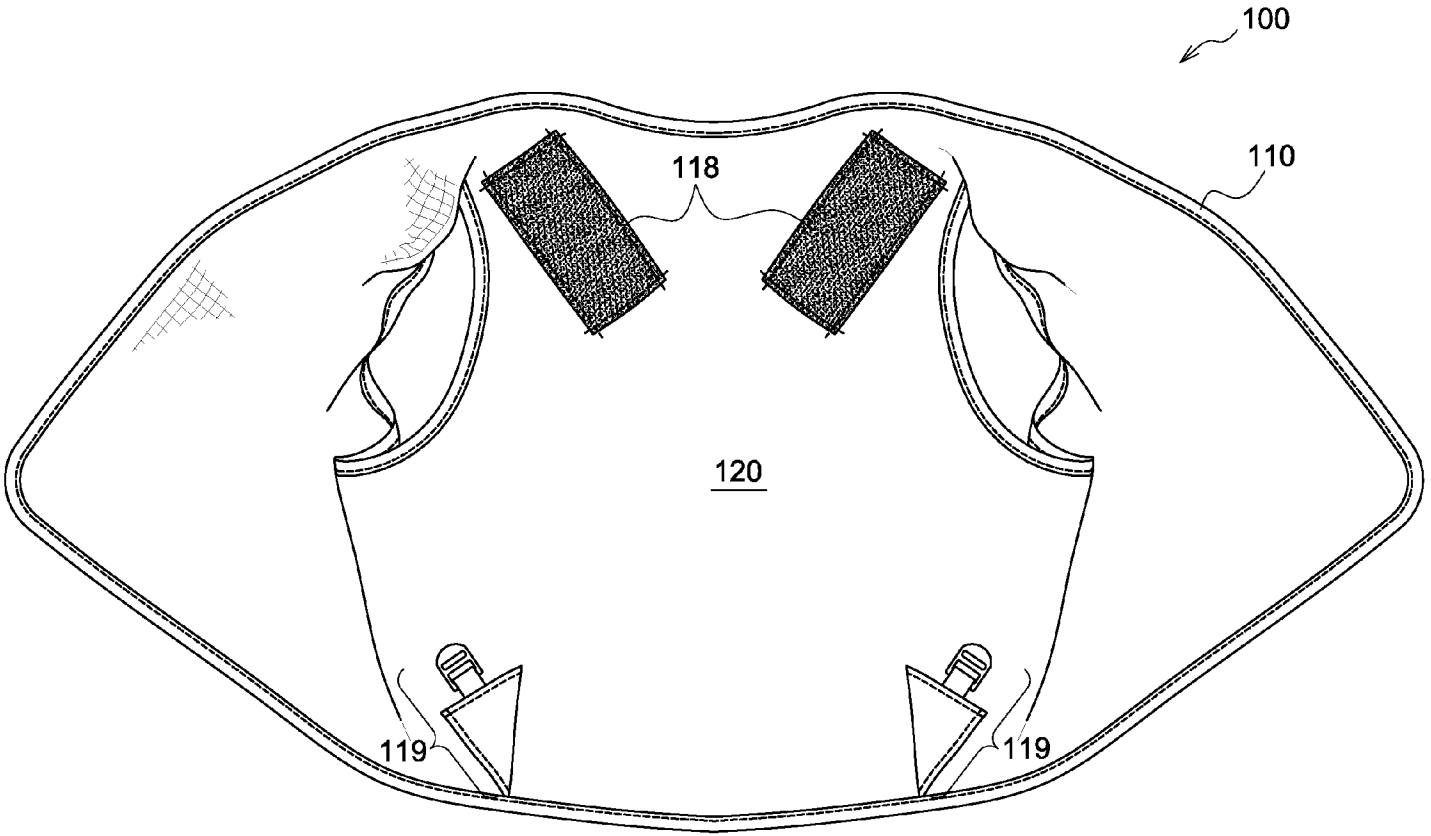
FIG. 2B is a front elevation view of a modular fishing vest system with the vest open to expose the vest interior, according to an embodiment of the present invention.

Embodiments of the present invention include a modular fishing vest system that combines the load capacity of a backpack with gear organization advantages and other benefits of a fishing vest. The modular fishing vest system typically comprises a fishing vest with a first storage module coupled to a back side of the vest. The first storage module can resemble a backpack, and is typically removably coupled to the vest. The modular fishing vest system typically includes shoulder straps installed inside the fishing vest in order to transfer load to a user's shoulders where the load can be borne relatively comfortably. The shoulder straps are typically removably coupled to an inside surface of the fishing vest.

The shoulder straps are typically adapted to be uninstalled from inside the fishing vest and installed on the first storage module when the module is separated from the vest. So configured, the first storage module can be worn like a backpack with or without the fishing vest.

The modular fishing vest system further comprises second storage modules that attach to the vest. The second storage modules, typically, but not necessarily, install on a front side of the vest. The second storage modules are similar to pockets found on prior art fishing vests, except the modules are typically removable, and can be interchangeable among various mounting locations on the vest. The second storage modules can include a shelf pocket that opens to provide a shelf approximately horizontally disposed, on which pocket contents or other items can be supported.

The modular fishing vest system can further comprise a lure box configured to be removably installed on the fishing vest in place of or in addition to a second storage module. The lure box can be installed on a front outside surface of the fishing vest using hook and loop material or other fasteners such as, but not limited to, buttons, zippers, snaps, and buckles.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The terms "removable", "removably coupled", "removably installed," "readily removable", "readily detachable", "detachably coupled", "separable," "separably coupled," and similar terms, as used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure.

Directional or relational terms such as "top," bottom," "front," "back," "above," "beneath," and "below," as used in this specification and appended claims, refer to relative positions of identified elements, components, or objects, where the components or objects are oriented in an upright position as normally installed or used.

The term "lure box," as used in this specification and appended claims, refers to relatively small boxes familiar to persons skilled in the art, that are used to carry fishing lures and tackle, including hooks, flies, weights, leaders, tippets, etc. Lure boxes are typically hard sided and contain multiple compartments for segregating lures or tackle. Boxes especially adapted to carrying fishing flies, sometimes referred to as fly boxes, are considered lure boxes.

A First Embodiment Modular Fishing Vest System

A first embodiment modular fishing vest system 100 is illustrated in FIGS. 1-7. The first embodiment modular fishing vest system 100 comprises a fishing vest 110 having shoulder straps 115 detachably installed inside the vest 110. Each shoulder strap 115 of the first embodiment is coupled to a vest inside surface 120 at two locations. The two locations typically include an upper strap coupling mechanism 117 and a lower strap attachment 119. The upper strap coupling mechanism 117 can include hook and loop material, wherein a vest strap contact patch 118 is affixed (typically sewn) to the vest inside surface 120. The vest strap contact patch 118 comprises hook material or loop material. The upper strap coupling mechanism 117 further comprises hook material or loop material that is complementary to the vest strap contact patch 118, and which is typically sewn onto the shoulder strap 115. The vest strap contact patch 118 typically, but not necessarily, comprises loop material, and hook material is therefore typically the complementary material sewn to the shoulder strap 115. In some embodiments the lower strap attachment 119 of the first embodiment comprises a fabric section affixed (typically sewn) to the vest inside surface 120, and a buckle affixed to the fabric section. Embodiments of upper strap coupling mechanisms and lower strap attachments include, but are not limited to, hook and loop material, buckles, snaps, buttons, and zippers.

Figure 3A:
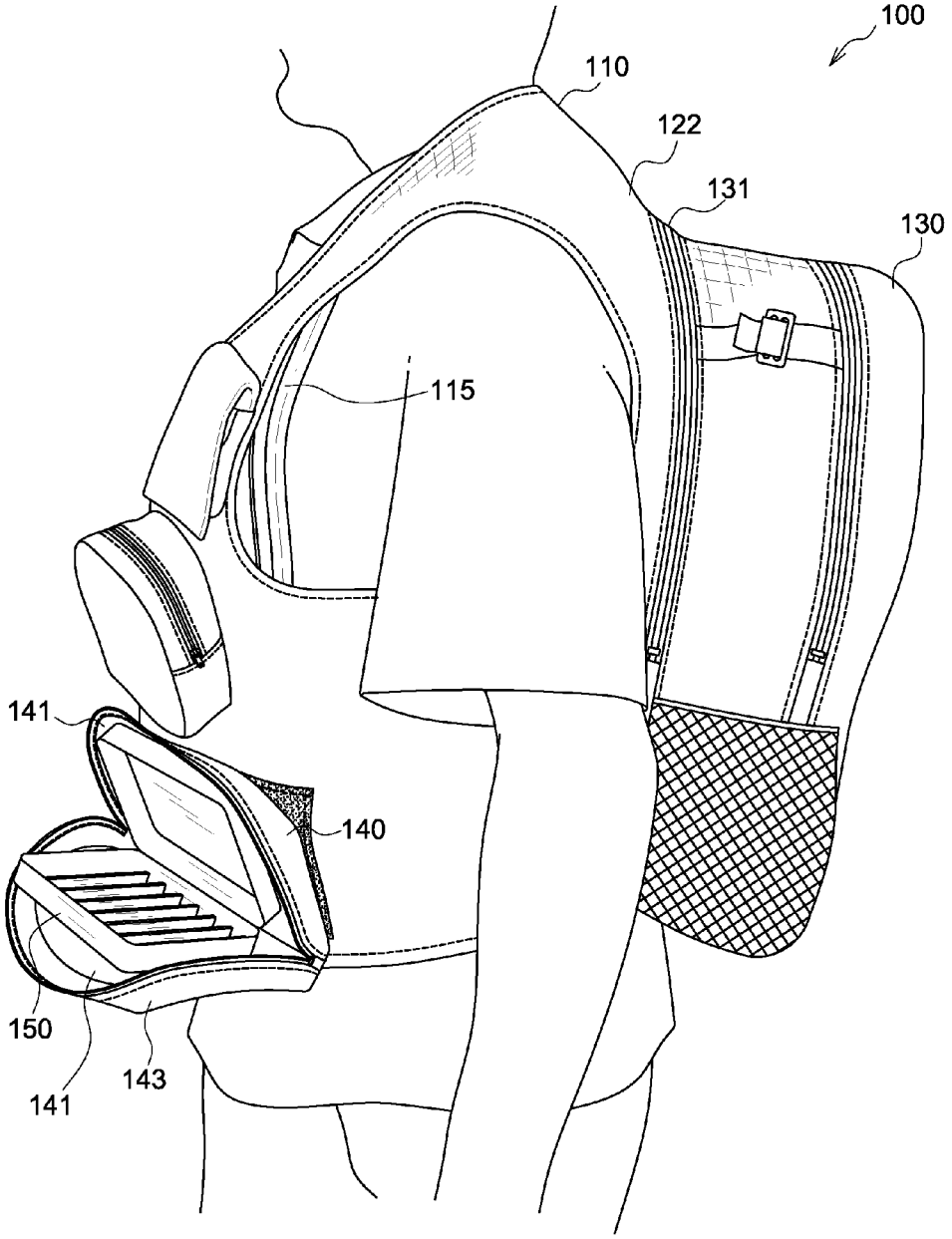
FIG. 3A is a side perspective view of a modular fishing vest system being worn by a user, according to an embodiment of the present invention.
Figure 3B:
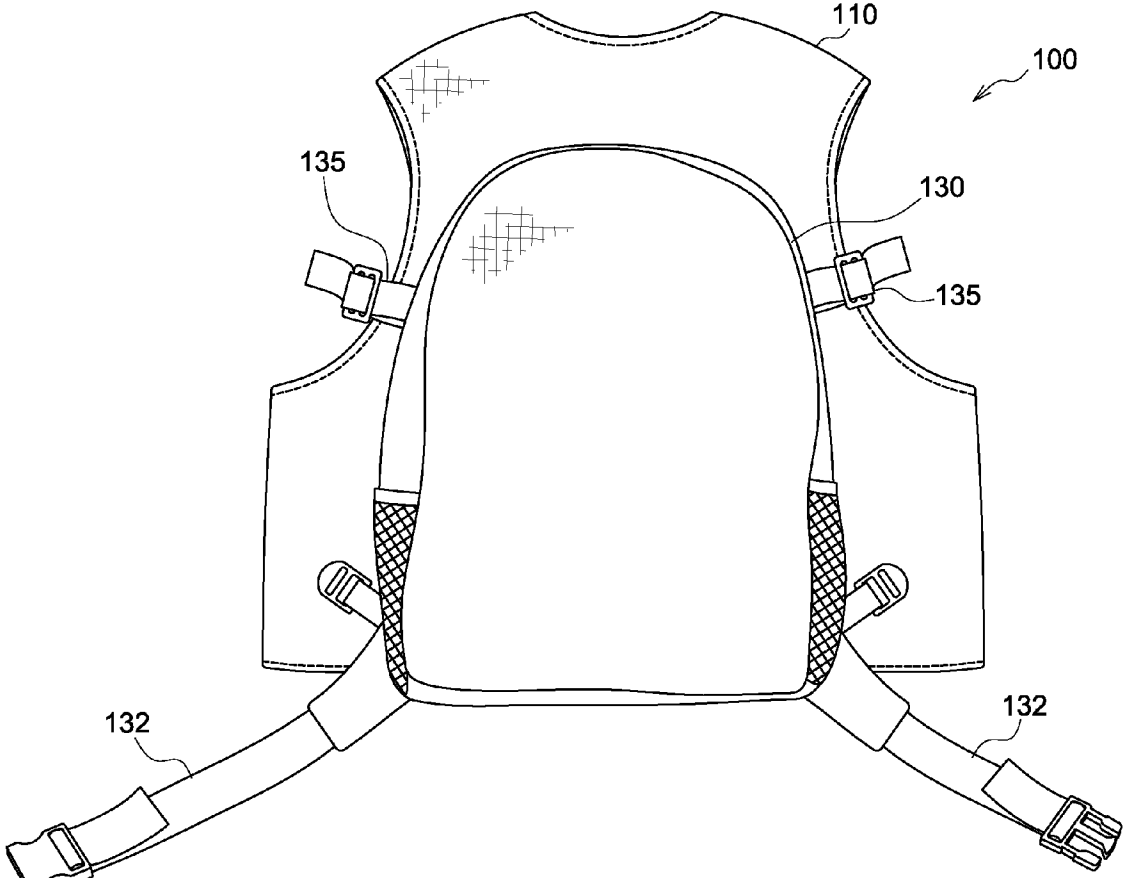
FIG. 3B is a rear elevation view of a modular fishing vest system according to an embodiment of the present invention.
Figure 3C:
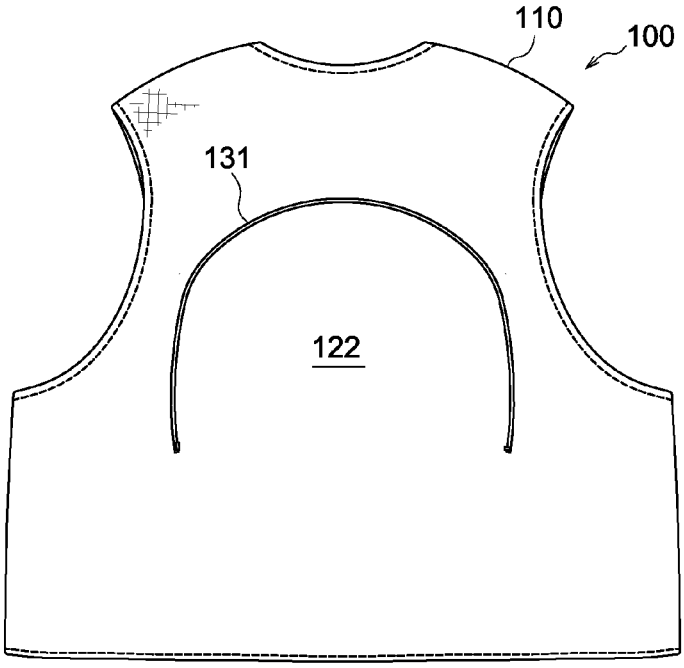
FIG. 3C is rear elevation view of a modular fishing vest system with a first storage module uninstalled from a fishing vest, according to an embodiment of the present invention.
Figure 3C:
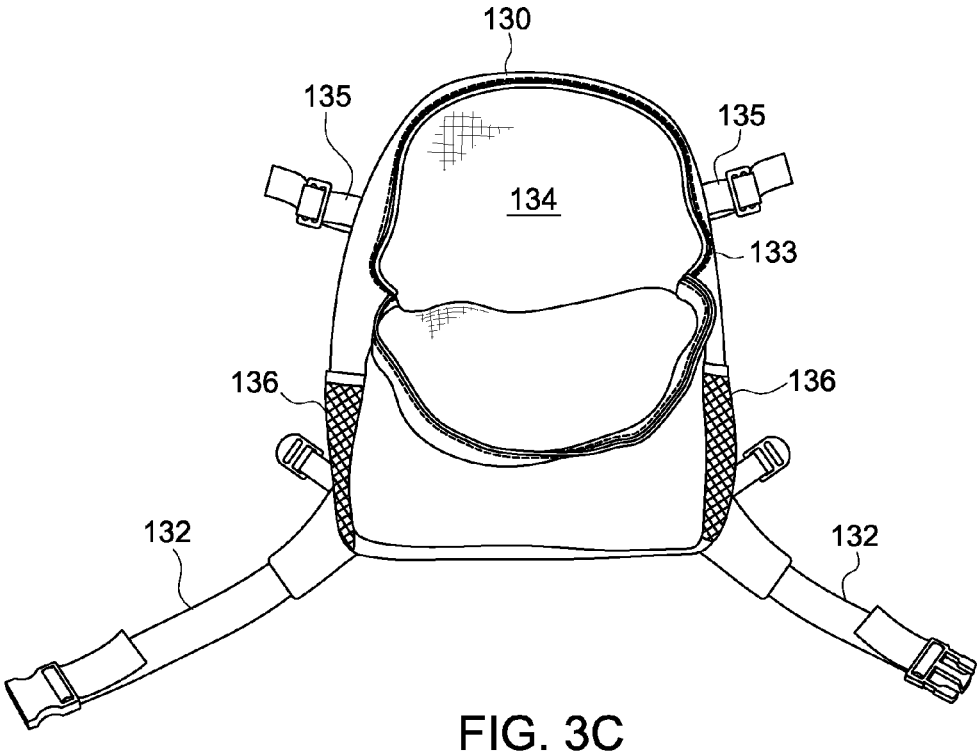

The first embodiment modular fishing vest system 100 further comprises a first storage module 130 and multiple second storage modules 140. As best shown in FIGS. 3A-3C, the first storage module 130 can be installed on a vest outer back side 122, or detached therefrom. The first storage module 130 of the first embodiment is detachably coupled to the fishing vest 110 by a zipper 131. Other embodiments include detachable couplers including, but not limited to, hook and loop material, buckles, snaps, and buttons. FIG. 3C shows the fishing vest 110 with the first storage module 130 detached. The first storage module includes a waist belt 132 and a zippered portal 133 (shown in an open orientation in FIG. 3C) to an interior cavity 134. The interior cavity 134 is typically lined with loop material. Embodiments include interior cavities lined with hook material or loop material. The first storage module 130 further comprises adjustable loops 135 adapted to secure a fishing rod to the module. In typical use, an end of a fishing rod can reside in a mesh pocket 136 with the adjustable loop 135 secured around the rod.

As shown in FIG. 3A, one of the multiple second storage modules 140 is a shelf pocket that opens to provide a shelf 143 approximately horizontally disposed. The first embodiment modular fishing vest system further comprises a lure box 150, illustrated in FIG. 3A disposed in an open configuration on the shelf 143 of the shelf pocket. The lure box 150 includes hook material or loop material that is complementary to hook material or loop material forming a module inside surface 141 of the second storage module 140, and by which the lure box 150 adheres to the module inside surface 141.

Figure 4A:
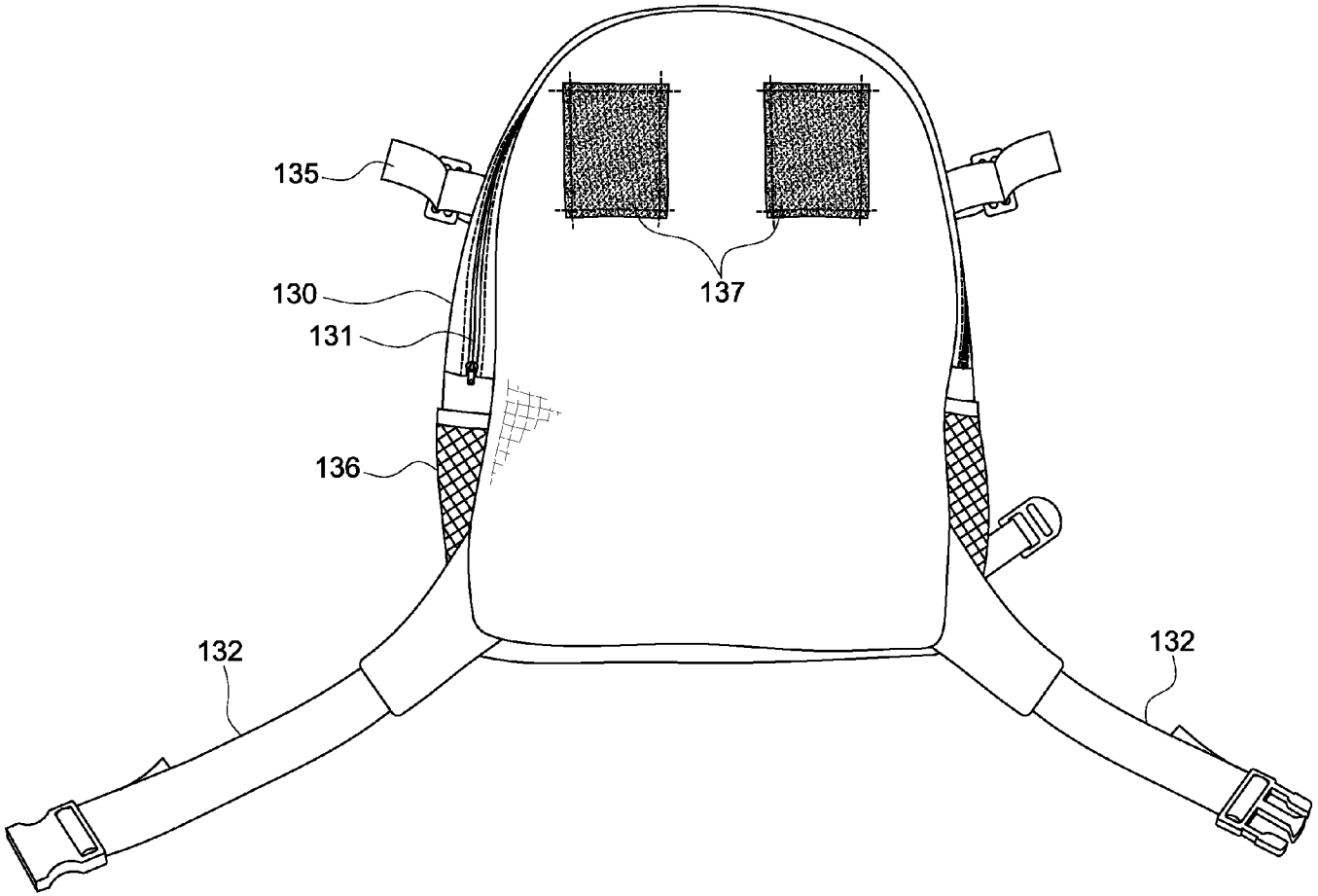
FIG. 4A is a rear elevation view of a first storage module of a modular fishing vest system according to an embodiment of the present invention.
Figure 4B:
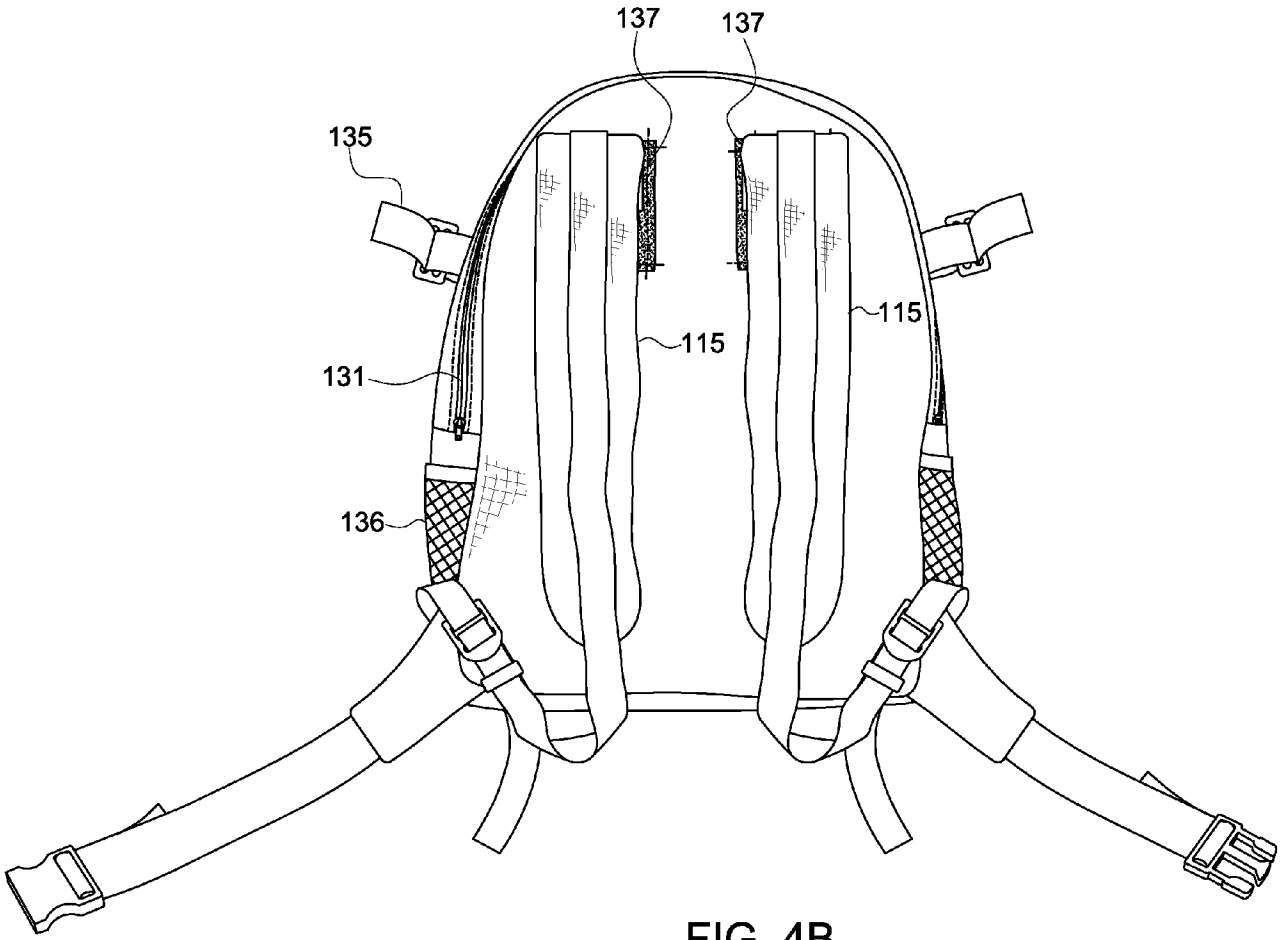
FIG. 4B is a front elevation view of a first storage module of a modular fishing vest system, with shoulder straps installed on the module, according to an embodiment of the present invention.

FIGS. 4A and 4B show the first storage module 130 from the front side, i.e. the side that that faces the fishing vest outer back side 122 when the module 130 is installed on the vest 110. The shoulder straps 115 that have been removed from inside the fishing vest 110 are shown installed on the first storage module 130 FIG. 4B. The shoulder straps are absent in FIG. 4A, which provides an unimpeded view of first storage module strap contact patches 137 affixed to the module 130. The first storage module strap contact patches 137 comprise hook material or loop material. The shoulder straps 115 include hook material or loop material that is complementary to the contact patches 137, thus facilitating adherence of the shoulder straps to the contact patches 137. The first storage module strap contact patches 137 and the vest strap contact patches 118 typically include the same material, be it hook material or loop material, and the shoulder straps 115 typically include hook material or loop material that is complementary to the first storage module strap contact patches 137 and to the vest strap contact patches 118. Thus the first embodiment shoulder straps 115 attach to the first storage module 130 and the fishing vest 110 by the same type of coupling mechanism, which typically includes hook and loop material.

Figure 5:
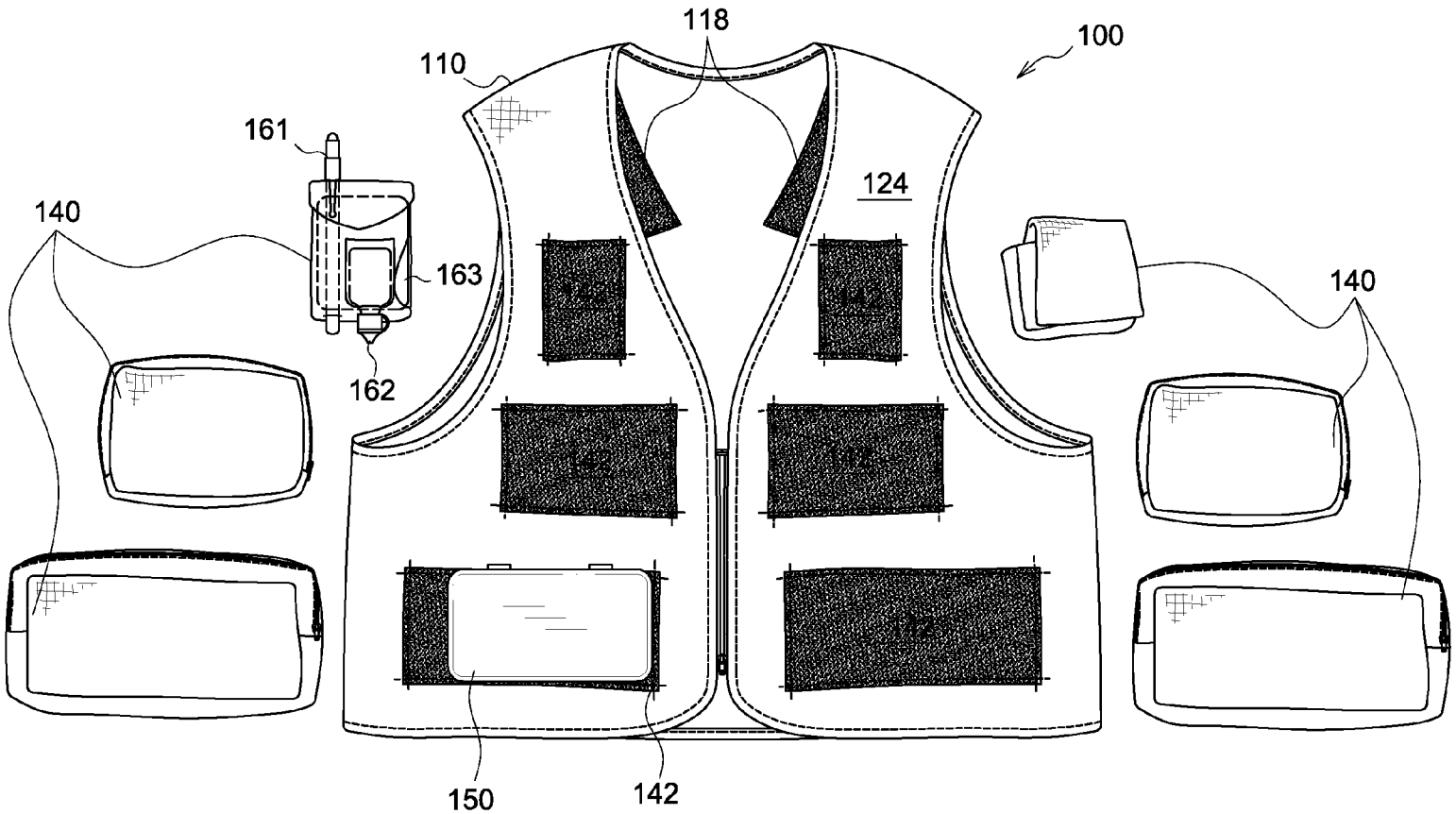
FIG. 5 is a front elevation view of a modular fishing vest system, with second storage modules uninstalled from a fishing vest, according to an embodiment of the present invention.

As best shown in FIGS. 1, 3A, and 5, the multiple second storage modules 140 are typically detachably coupled to a vest outer front side 124. FIG. 5 illustrates the modular fishing vest system 100 with the second storage modules 140 detached from the vest outer front side 124. With the second storage modules 140 detached, second storage module contact patches 142 are visible on the vest outer front side 124. The second storage modules 140 of the first embodiment are typically coupled to the vest outer front side 124 by hook and loop material. The second storage module contact patches 142 typically comprise hook material or loop material, with the second storage modules 140 including hook material or loop material that is complementary to the second storage module contact patches 142.

FIG. 5 illustrates the lure box 150 removably adhered to a second storage module contact patch 142. The lure box 150 includes hook material or loop material that is complementary to the second storage module contact patch 142. The lure box 150 illustrated in FIG. 5 is a fly box, which can be carried in one of the larger second storage modules 140 or adhered to a second storage module contact patch 142 as shown in FIG. 5. As seen in FIGS. 1 and 5, one of the multiple second storage modules 142 carries a thermometer 161, fly dressing 162, and a second lure box 163, typical fishing tackle carried by the modular fishing vest system 100.

Figure 6:
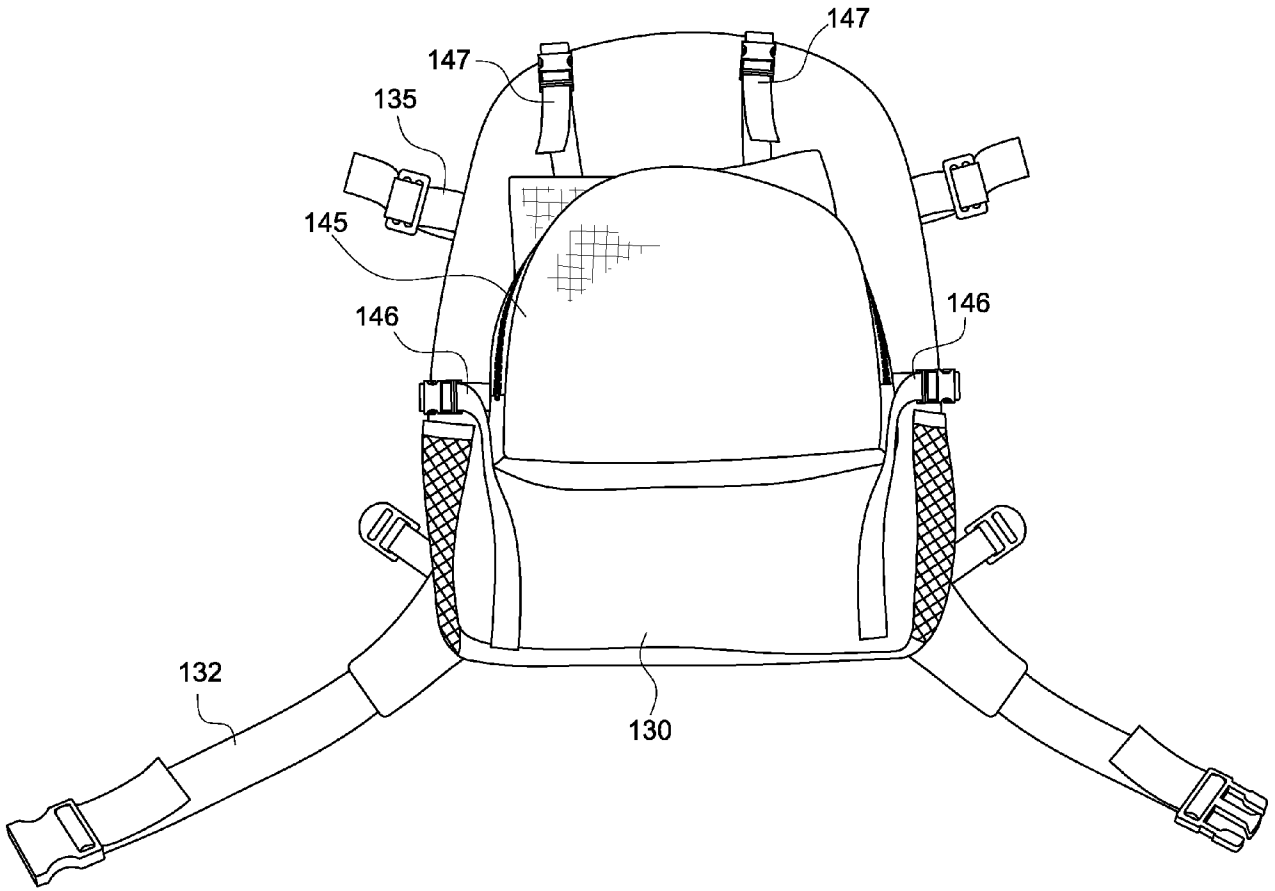
FIG. 6 is a rear elevation view of a third storage module mounted on a first storage module of a modular fishing vest system according to an embodiment of the present invention.
Figure 7:
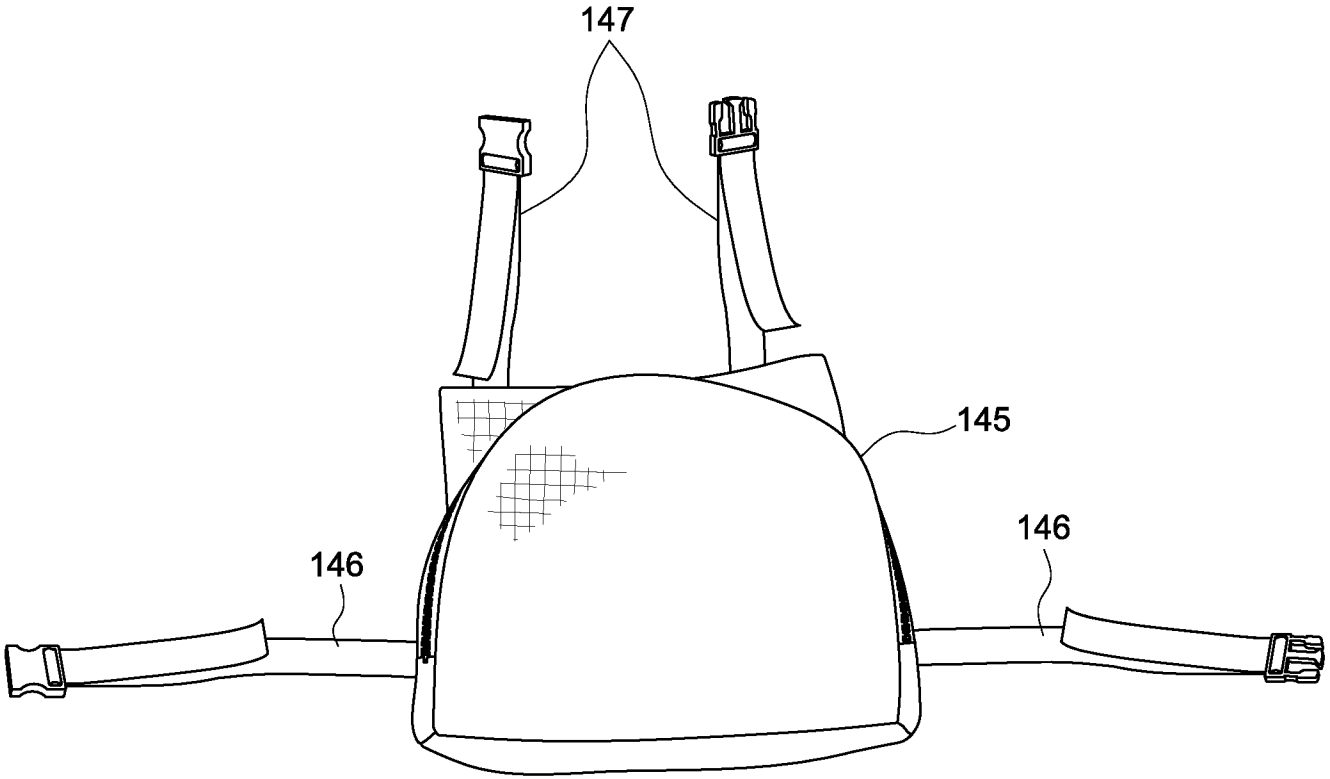
FIG. 7 is a rear elevation view of a third storage module of a modular fishing vest system according to an embodiment of the present invention.

As best seen in FIGS. 6-7, the first embodiment modular fishing vest system further comprises a third storage module 145. In FIG. 6, the third storage module 145 is shown detachably affixed to the first storage module 130 by third module lower couplers 146 and third module upper couplers 147.

FIG. 7 shows the third storage module 145 detached from the first storage module. The third storage module 145 is designed and adapted to be worn as a chest pack, wherein the third module upper couplers 147 join together to form a loop that a user wears around his or her neck. Alternatively, as shown in FIG. 6, the upper couplers 147 can be utilized to engage buckles on the first storage module 130 to secure the third storage module 145 thereupon.

The third storage module 145 is further designed and adapted to be worn as a fanny pack, wherein the third module lower couplers 146 join together to form a waist belt that a user wears around his or her waist. Conversely, as shown in FIG. 6, the lower couplers 146 are configured to engage buckles on the first storage module 130 to secure the third storage module 145 to the first module 130.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A method of using a modular fishing vest system comprising:

providing a modular fishing vest system including:

a fishing vest including shoulder straps having ends removably coupled to an interior surface of the vest; and a first storage module removably coupled to an outer back side of the fishing vest, wherein the shoulder straps are configured to be removed from inside the fishing vest and attached to the first storage module;

wherein the ends of the shoulder straps are fixed to the interior surface of the vest when they are coupled to the vest;

wearing the fishing vest with the shoulder straps coupled to the interior surface of the fishing vest;

removing the shoulder straps and the first storage module from the fishing vest;

installing the shoulder straps on the first storage module; and wearing the first storage module like a backpack.

2. The method of claim 1, wherein:

the shoulder straps are removably coupled to the fishing vest by an upper strap coupling mechanism; and the shoulder straps are configured to removably couple to the backpack by a same type of coupling mechanism as the upper strap coupling mechanism.

3. The method of claim 2, wherein the upper strap coupling mechanism and the same type of upper strap coupling mechanism include hook and loop material.

4. The method of claim 1, further comprising a second storage module removably coupled to the fishing vest.

5. The method of claim 4, further comprising a lure box configured to reside inside the second storage module and to removably couple to an outside surface of the fishing vest in the absence of the second storage module.

6. The method of claim 5, wherein the fishing vest further includes multiple second storage module contact patches and the second storage module includes multiple second storage modules configured to be interchangeably installed among the multiple second storage module contact patches.

7. The method of claim 4, wherein the second storage module includes a shelf pocket.

8. The method of claim 5, wherein the first storage module includes an internal cavity lined with hook material or loop material.

9. The method of claim 1, further comprising wearing the fishing vest without the shoulder straps.

10. A method of using a modular fishing vest system comprising:

providing a modular fishing vest system including:

a fishing vest including shoulder straps having ends detachably mounted to an interior surface of the vest;

a first storage module removably coupled to an outer back side of the fishing vest, wherein the shoulder straps are configured to be removed from inside the fishing vest and attached to the first storage module to enable wearing the first storage module as a backpack without the fishing vest;

multiple second storage module contact patches; and multiple second storage modules configured to be interchangeably installed among the multiple second storage module contact patches;

wherein the ends of the shoulder straps are fixed to the interior surface of the vest when they are coupled to the vest;

wearing the fishing vest with the shoulder straps coupled to the interior surface of the fishing vest;

removing the shoulder straps and the first storage module from the fishing vest;

installing the shoulder straps on the first storage module; and wearing the first storage module like a backpack.

11. The method of claim 10, further comprising a lure box configured to reside inside at least one of the second storage modules, and to removably couple to at least one of the multiple second storage module contact patches in the absence of the at least one of the multiple second storage modules.

12. The method of claim 10, wherein the first storage module is lined with loop material and at least one of the multiple second storage modules is a shelf pocket.

13. A method of using a modular fishing vest system, the method comprising:

providing a modular fishing vest system including:

a fishing vest including shoulder straps having ends removably coupled to an interior surface of the vest; and a first storage module removably coupled to an outer back side of the fishing vest;

wherein the ends of the shoulder straps are fixed to the interior surface of the vest when they are coupled to the vest;

wearing the fishing vest with the shoulder straps coupled to the interior surface of the fishing vest and the first storage module installed on an outer back side of the fishing vest;

removing the shoulder straps from inside the fishing vest and wearing the fishing vest without the shoulder straps;

removing the first storage module from the outer back side of the fishing vest;

installing the shoulder straps on the first storage module; and wearing the first storage module like a backpack with the shoulder straps directly coupled to the first storage module.

* * * * *